US007871070B2

(12) United States Patent
Ruff et al.

(10) Patent No.: US 7,871,070 B2
(45) Date of Patent: Jan. 18, 2011

(54) MATERIAL HANDLING APPARATUS

(75) Inventors: Arlington D. Ruff, Johnville (CA); Clifford A. Ruff, Negley, OH (US); Jürgen F. Trost, Canfield, OH (US)

(73) Assignee: Padana AG, Baar (CH)

( * ) Notice: Subject to any disclaimer, the term of this patent is extended or adjusted under 35 U.S.C. 154(b) by 1715 days.

(21) Appl. No.: 11/075,462

(22) Filed: Mar. 9, 2005

(65) Prior Publication Data

US 2006/0202410 A1 Sep. 14, 2006

(51) Int. Cl.
*B65H 31/12* (2006.01)

(52) U.S. Cl. ..... 271/218; 271/213; 271/189; 414/790.8

(58) Field of Classification Search ..... 271/218, 271/189, 220, 223; 414/790.8, 790.5, 790.6
See application file for complete search history.

(56) References Cited

U.S. PATENT DOCUMENTS

| | | | | |
|---|---|---|---|---|
| 2,631,715 | A | 3/1953 | Vickers | |
| 3,108,509 | A | 10/1963 | Felix | |
| 3,698,708 | A | 10/1972 | Brawn | |
| 3,759,402 | A * | 9/1973 | Hitch et al. | 414/790.3 |
| 4,035,904 | A | 7/1977 | Ishizaka et al. | |
| 4,194,633 | A | 3/1980 | Paterson et al. | |
| 4,557,656 | A | 12/1985 | Ouellette | |
| 4,667,953 | A | 5/1987 | Hirakawa et al. | |
| 4,796,879 | A * | 1/1989 | Martini et al. | 271/218 |
| 4,934,687 | A * | 6/1990 | Hayden et al. | 271/202 |
| 4,983,096 | A * | 1/1991 | Bodewein | 414/789.5 |
| 5,062,218 | A | 11/1991 | Weil | |
| 5,074,743 | A * | 12/1991 | Schaffner et al. | 414/790.8 |
| 5,150,746 | A | 9/1992 | Weil | |
| 5,358,375 | A | 10/1994 | Kawada et al. | |

(Continued)

FOREIGN PATENT DOCUMENTS

| | | |
|---|---|---|
| GB | 1183752 | 3/1970 |

(Continued)

*Primary Examiner*—Stefanos Farmis
*Assistant Examiner*—Luis Gonzalez
(74) *Attorney, Agent, or Firm*—Barnes & Thornburg LLP

(57) ABSTRACT

A conveyor conveys sheets and deposits the sheets at a location to be stacked. The conveyor includes a sensor for determining the presence of a sheet before the sheet arrives at the location. A controller is coupled to the sensor and responsive to sensor inputs for controlling a movable support for projecting into a projected orientation to receive the sheets as the sheets exit the conveyor. The movable support moves to a retracted orientation to assist a stack to be withdrawn therefrom. Apparatus for manipulating pallets includes a conveyor, a mechanism for tilting the conveyor between a generally horizontal orientation and an orientation in which a first end of the conveyor is elevated above a second end of the conveyor, a first shifting mechanism to shift the conveyor horizontally along a first axis, a second shifting mechanism for shifting the conveyor horizontally along a second axis generally perpendicular to the first axis, and an elevator mechanism for raising and lowering the conveyor along a third axis generally perpendicular to the first and second axes. Apparatus for dispensing a pallet includes vertically spaced magazines, conveyors, and an elevator. The conveyors and elevator are selectively operable to deliver a pallet from the magazine in which that pallet is located to a common location.

22 Claims, 13 Drawing Sheets

U.S. PATENT DOCUMENTS

| | | | | |
|---|---|---|---|---|
| 5,490,752 | A | 2/1996 | Tokiwa et al. | |
| 5,493,104 | A | 2/1996 | Wilson | |
| 5,494,400 | A * | 2/1996 | Mendoza et al. | 414/790.8 |
| 5,586,465 | A * | 12/1996 | Alcini et al. | 72/441 |
| 5,628,505 | A * | 5/1997 | Voss | 271/218 |
| 5,707,058 | A * | 1/1998 | Hirth et al. | 271/176 |
| 5,882,175 | A | 3/1999 | Villacieros Fernandez | |
| 5,979,524 | A | 11/1999 | Trost | |
| 6,102,090 | A | 8/2000 | Gruender et al. | |
| 6,106,218 | A * | 8/2000 | Schubart et al. | 414/790.2 |
| 6,386,812 | B2 | 5/2002 | Garlichs et al. | |
| 6,474,379 | B1 | 11/2002 | Mellor et al. | |
| 6,497,549 | B2 | 12/2002 | Brown | |
| 6,609,875 | B1 | 8/2003 | Araki | |
| 6,845,859 | B2 | 1/2005 | Grundl | |
| 7,125,216 | B2 * | 10/2006 | Grewe et al. | 414/790.8 |
| 7,178,801 | B2 * | 2/2007 | Kokubo et al. | 271/213 |
| 7,308,968 | B2 | 12/2007 | Denison | |

FOREIGN PATENT DOCUMENTS

| | | |
|---|---|---|
| WO | WO 03/070440 A2 | 8/2003 |
| WO | 2005/092706 | 10/2005 |
| WO | 2006/098717 | 9/2006 |

* cited by examiner

MATERIAL HANDLING APPARATUS

FIELD OF THE INVENTION

This invention relates to material handling apparatus. It is disclosed in the context of handling of sheets of wood veneer after they have been sliced from a flitch. However, it is believed to be useful in other applications as well.

BACKGROUND OF THE INVENTION

During the processing of wood for the manufacture of veneer, logs to be processed are typically surfaced, converted into flitches by splitting them lengthwise into halves, thirds, quarters, or the like, hereinafter sometimes flitches, and further shaping. The flitches are then steeped in hot water which prepares them for slicing. The soaking aids the slicing process. After slicing of the flitch into sheets of veneer, the sheets of veneer are typically passed through a dryer to remove moisture from the sliced veneer.

A typical drying operation includes a pass of several tens to several hundreds of feet on a conveyor through a dryer which is maintained at a temperature of a few hundred degrees Fahrenheit to remove as much of the excess moisture as it is prudent to remove from the typically relatively thin (on the order of several tens of thousandths of an inch) sheets of veneer. After passing through the dryer, the sheets are borne off the conveyor at the exit end of the dryer at an offbearers' station.

Care is usually taken to package all the veneer that has been cut from a flitch together. That is, the veneer is reassembled into a stack of all the usable sheets obtained from the original flitch. Some unusable sheets, such as sheets damaged in processing, sheets that were not large enough, and the like, are discarded. The process of offbearing and stacking requires some attention on the part of the offbearers who unload the sheets of veneer from the conveyor and stack them, care on the offbearers' part not to get sheets from one flitch mixed with sheets from another flitch, and so on. The sheets come off the dryer conveyor at a relatively high frequency in a typical drying operation. It is not unusual for offbearers to be presented a sheet every second or so for stacking. Anything that can be done to ease the fairly steady, fairly brisk pace of activity at the offbearers' station has the potential to reduce mishandling and any consequent damage and stacking errors in the offbearing and stacking process, and thereby increase the overall yield of the process.

The disclosures of U.S. Pat. Nos. 5,062,218; 5,150,746; 5,979,524; 6,102,090; 6,474,379 and WO 03/070440 are hereby incorporated herein by reference. This listing is not intended to be a representation that a complete search of all relevant art has been made, or that no more pertinent art than that listed exists, or that the listed art is material to patentability. Nor should any such representation be inferred.

DISCLOSURE OF THE INVENTION

According to an aspect of the invention, a conveyor is provided for conveying sheets and for depositing the sheets at a location to be stacked into stacks of sheets. The conveyor includes a sensor for determining the presence of a sheet before the sheet arrives at the location. A controller is coupled to the sensor and responsive to sensor inputs for controlling a first movable support for projecting into a projected orientation to receive the sheets as the sheets exit the conveyor. The first movable support moves to a retracted orientation to assist a stack to be withdrawn therefrom.

Illustratively according to this aspect of the invention, the apparatus comprises a second movable support for projecting into a projected orientation to receive the sheets as the sheets exit the conveyor. The second movable support moves to a projected orientation before the first movable support moves to a retracted orientation.

Illustratively according to this aspect of the invention, the apparatus comprises a plurality of movable supports. The sheets comprise sheets of varying length. The sensor comprises a sensor for determining the presence and length of the sheets and for signaling to the controller the length of the sheets being conveyed. The controller separately controls the movable supports to project only that number of movable supports that lie within the length of the sheets being conveyed.

Illustratively according to this aspect of the invention, the apparatus comprises a movable support adapted to project varying distances. The sheets comprise sheets of varying width. The sensor comprises a sensor for determining the presence and width of the sheets and for signaling to the controller the width of the sheets being conveyed. The controller controls the movable support to project the movable support a distance necessary to support the width of the sheets being conveyed.

Illustratively according to these aspects of the invention, the apparatus includes a drive for projecting the movable support into a projected orientation. The drive is coupled to the controller to be controlled thereby.

Illustratively, the drive comprises a magnetic coupler adapted to be overcome if the movable support encounters resistance to projection into the projected orientation.

Illustratively according to these aspects of the invention, the apparatus includes devices for retarding motion of the sheets as the sheets exit the conveyor. The devices are movably supported with respect to the conveyor.

Illustratively according to these aspects of the invention, the devices are movably supported so that their distances from a surface of the conveyor can be separately adjusted to accommodate sheets having non-uniform widths.

According to another aspect of the invention, apparatus for manipulating pallets includes a conveyor and a tilting mechanism coupled to the conveyor for tilting the conveyor between a generally horizontal orientation and an orientation in which a first end of the conveyor is elevated above a second end of the conveyor. The apparatus further includes a first shifting mechanism to shift the conveyor horizontally along a first axis and an elevator mechanism for raising and lowering the conveyor along a second axis generally perpendicular to the first axis.

Illustratively according to this aspect of the invention, the apparatus further includes a second shifting mechanism for shifting the conveyor horizontally along a third axis generally perpendicular to the first and second axes.

According to another aspect of the invention, apparatus for manipulating pallets includes a conveyor and a tilting mechanism coupled to the conveyor for tilting the conveyor between a generally horizontal orientation and an orientation in which a first end of the conveyor is elevated above a second end of the conveyor. The apparatus further includes a first shifting mechanism to shift the conveyor horizontally along a first axis and a second shifting mechanism for shifting the conveyor horizontally along a second axis generally perpendicular to the first axis.

Illustratively according to this aspect of the invention, the apparatus further includes an elevator mechanism for raising and lowering the conveyor along a third axis generally perpendicular to the first and second axes.

According to another aspect of the invention, apparatus for manipulating pallets includes a conveyor, a first shifting mechanism to shift the conveyor horizontally along a first axis, a second shifting mechanism for shifting the conveyor horizontally along a second axis generally perpendicular to the first axis, and an elevator mechanism for raising and lowering the conveyor along a third axis generally perpendicular to the first and second axes.

Illustratively according to this aspect of the invention, the apparatus further includes a tilting mechanism coupled to the conveyor for tilting the conveyor between a generally horizontal orientation and an orientation in which a first end of the conveyor is elevated above a second end of the conveyor.

According to another aspect of the invention, apparatus for dispensing a pallet includes n vertically spaced magazines, n an integer, n conveyors, and an elevator. The conveyors and elevator are selectively operable to deliver a pallet from the magazine in which that pallet is located to a common location.

Illustratively according to this aspect of the invention, each magazine includes a dogging mechanism for releasing one pallet at a time onto its respective conveyor.

Illustratively according to this aspect of the invention, the dogging mechanism includes a pair of shafts mounted for rotation and a prime mover for rotating the shafts. Each shaft includes at least one dog. The shafts have first orientations in which the dogs interfere with the deposit of a pallet onto its respective conveyor and second orientations in which the dogs do not interfere with the deposit of a pallet onto its respective conveyor.

Illustratively according to this aspect of the invention, the dogging mechanism is adapted to lift pallets other than the pallet which is deposited on its respective conveyor off the pallet which is deposited on its respective conveyor as the dogging mechanism moves from its second orientation to its first orientation.

Illustratively according to this aspect of the invention, the elevator mechanism includes two elements. Rollers are provided on each element. The rollers on each element are spaced apart from the rollers on the other element a width greater than the width of the bottom-most conveyor. As the elevator delivers a pallet to the bottom-most conveyor, the rollers on the two elements straddle the bottom-most conveyor.

BRIEF DESCRIPTION OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Figure 1:
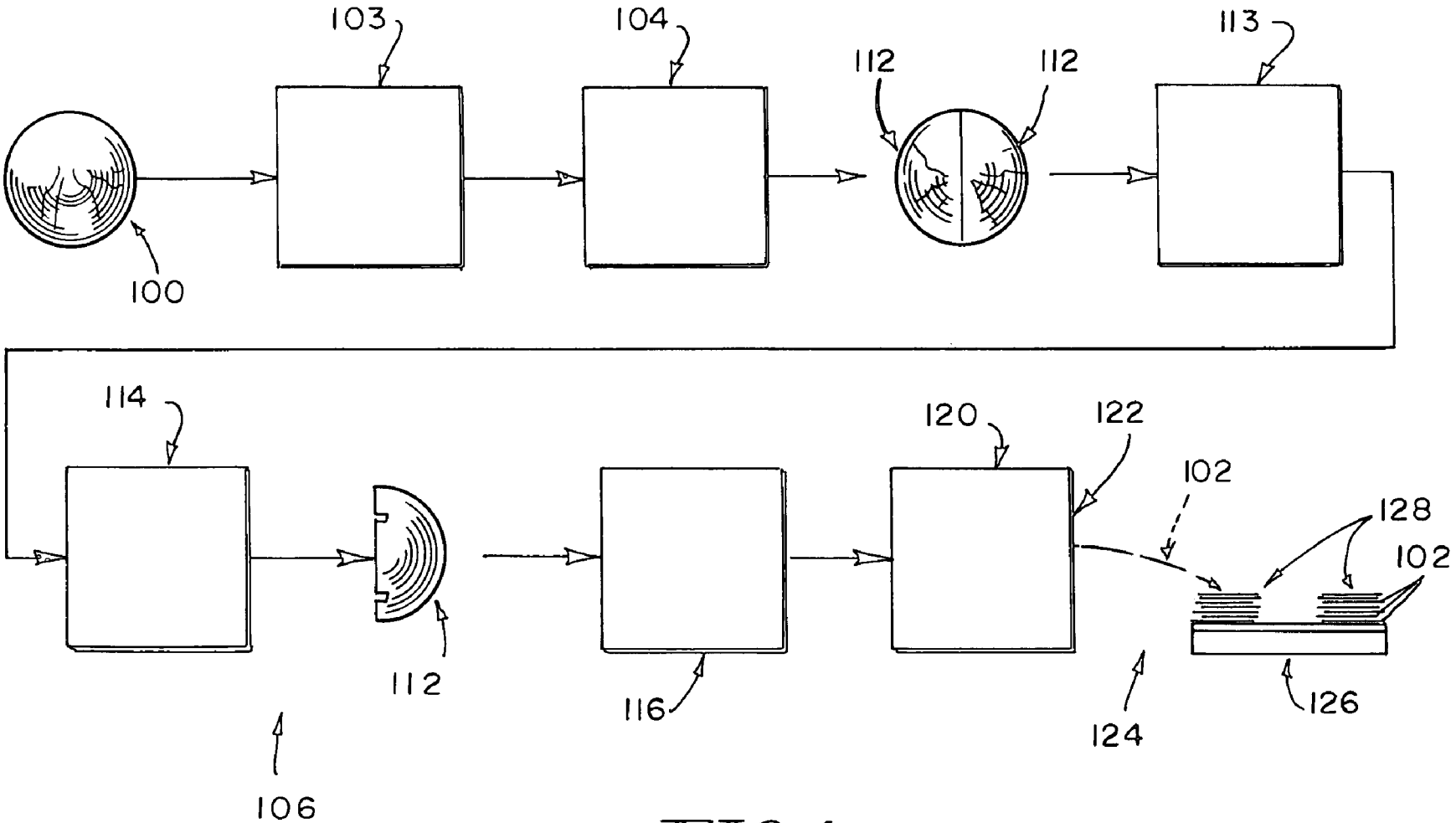
FIG. 1 illustrates in block form a process for the production of sheets of veneer.

A process for converting logs 100 into sheets 102 of veneer proceeds as illustrated in FIG. 1. First, the logs 100 are debarked 103. The logs 100 are then passed through a metal detector and readily removable foreign matter, such as nails, pieces of wire, and so on, is removed 104 from the logs 100. The logs 100 are then split lengthwise into halves, thirds, quarters, or the like, to create flitches 112. The logs 100 are then steeped 113 in (a) vat(s) of heated water at, for example, 150-180° F. Next, the flitches 112 are surfaced to optimize the contours of the flitches 112 for subsequent processing and prepared 114 for mounting them to a veneer slicer 116, for example, one of the type described in U.S. Pat. Nos. 5,150,746, 5,979,524 and 6,102,090. Preparation 114 may include, for example, further shaping of the longitudinal cross sections of the flitches 112. The surfacing and shaping apparatus may include, for example, apparatus of the type illustrated and described in U.S. Pat. No. 6,474,379 and/or WO 03/070440. Preparation 114 may further include the formation of one or more longitudinally extending grooves or the like in a prepared flat surface, for example, on the back side (side which is to be mounted to the flitch table of the veneer slicer 116) of the flitch 112. Such grooves or the like are used in the mounting of the flitch to the veneer slicer 116 in a manner described in, for example, U.S. Pat. No. 5,150,746.

The slicer 116 is then operated to slice sheets 102 of veneer from the flitch 112. The sheets 102 of veneer are removed from the slicer 116 and fed, typically by one or the other or both of hand operations and (a) conveyor(s), to the inlet end of a dryer 120, for example, of the type illustrated and described in U.S. Pat. No. 5,062,218. The sheets 102 pass sequentially through the dryer 120 and emerge from the outlet end 122 thereof. The sheets 102 reach an offbearers' station 124 where offbearers 125 catch and stack the sheets 102 on pallets 126 in bundles 128 of, for example, twenty-four sheets.

Turning now to the details of the offbearers' station 124, and referring generally to FIGS. 2-10, offbearers' station 124 is oriented directly adjacent a plurality of rollers 132 of a conveyor 134. Rollers 132 have belts 136 of conveyor 134 trained about them. Conveyor 134 is situated at the outlet end 122 of the dryer 120. The conveyor 134 extends beyond the outlet end 122 of the dryer 120 some distance. The sheets 102 pass through the outlet end 122 of dryer 120, and along conveyor 134 past (an) optical sensor(s) 137 which may be, for example, opposed arrays of infrared sources and detectors, for sensing the widths and lengths of the sheets 102 and supplying this information to a controller 138, such as, for example, a computer controller. For example, the optical sensor(s) 137 could include (an) opposed infrared source(s) mounted on a frame 154 above conveyor 134 and detector(s), mounted in openings provided in an upper surface of conveyor 134, and a clock in the controller 138 for generating periodic pulses in order that the widths of the sheets 102 passing between the source(s) and detector(s) may be calculated. Of course, if multiple lengths of sheets 102 are to be sensed, opposed infrared sources and detectors, for example, 137-*s*, 137-*m*, 137-*l*, could be positioned at multiple locations across conveyor 134 so that the various lengths of sheets 102 can be discriminated.

The controller 138 controls the positions of two sets 140, 142 of movable supports which are projected by (a) prime mover(s), such as pneumatic piston-and-cylinder motors or the like, to catch the sheets 102 as the sheets 102 are discharged over rollers 132 and off conveyor 134. At the beginning of each bundle 128 of sheets 102, the upper set 142 of supports is projected by its motor(s) 144. See FIG. 5. During this time, the lower set 140 of supports has been retracted to deposit a bundle 128 of sheets 102 onto a stack 130 on a pallet 126, and then projected by its motor(s) 146 into its orientation to support the next bundle 128 of sheets 102, the first few, for example, six, of which are being accumulated on supports 142. See FIG. 6.

After the first few sheets 102 of each bundle 128 are discharged, the upper set 142 of supports is retracted by its motor(s) 144, and the accumulated sheets 102 are deposited onto the lower set 140 of supports. See FIG. 7. As each bundle 128 increases toward its final size, the offbearers 125 must move it to the stack 130 on pallet 126. See FIG. 4. The lower set 140 of supports is retracted by its motor(s) 146, permitting the bundle 128 to be deposited onto the stack 130 on pallet 126. As the offbearers 125 move the bundle 128 to the stack 130, however, sheets 102 continue to come off the end of conveyor 134. In order to catch the first few sheets of the next bundle 128, the upper set 142 of supports is projected by its motor(s) 144, FIG. 5, and the process is repeated.

The controller 138 can also control the speed of the belts 136 by, for example, controlling the speed(s) of the motor(s) which drive(s) the belts 136 based upon the number of accumulated sheets 102 on pins 140 or 142. For example, the controller 138 can slow the belts 136 after delivery of the last sheet 102 forming a bundle 128, thereby slowing delivery of sheets 102 to offbearers' station 124 to permit pins 142 to project fully into their operative positions. Additionally, the offbearers' station 124 can be provided with variable speed fans 145, FIG. 2, which provide an upward circulation of air in the vicinity of the offbearers' station 124 to slow the descent of the sheets 102 from the level of the belts 136 to the top of the bundle 128 being assembled on pins 142 and/or 140. The controller 138 can also control the speeds of fans 145, for example, to provide greater airflow as the sheets 102 get wider and/or longer to assist in buoying the sheets 102, and to reduce this upward circulation, for example, as a bundle 128 is completed, in order to reduce the buoyant force on the sheets 102 to assist the offbearers 125 in handling the completed bundle 128 to the top of the stack 130.

The limits of travel of the supports 140, 142 may be controlled by the sensor 137-sensed widths of the sheets 102 exiting the dryer 120. This sensed width is supplied to the controller 138 which controls, via (a) prime mover(s) such as, for example, (a) hydraulic piston-and-cylinder motor(s) 147, the position of a stop 149 which stops the projecting motions of supports 140, 142. See, for example, FIGS. 5-7. Stop 149 and/or supports 140, 142 may be provided with shock-absorbing, for example, elastomeric tubing, bumpers 151. To assist the offbearers 125 in stacking the sheets 102 in orderly bundles 128, a registration surface 150 is provided at the end of conveyor 134. Registration surface 150 illustratively is a surface formed by boxing in rollers 132 and the axle on which rollers 132 are mounted between the rollers 132 using sheet metal. In addition, snubbers 152 are suspended for relatively free swinging movement from frame 154. Frame 154 illustratively is movably mounted upon the conveyor 134 and extends outward over the offbearers' station 124. See FIG. 4. Frame 154 is mounted on conveyor 134 by motors 133 at each side of the frame 154. Motors 133 can be, for example, electrically actuated linear positioners. With the motors 133 at the two sides of the frame 154, the two sides of frame 154 can be separately and independently moved to angle the array of snubbers 152 to registration surface 150 to accommodate sheets 102 which exhibit taper, that is, are somewhat trapezoidal when viewed from above conveyor 134.

The illustrative supports 140, 142 and snubbers 152 comprise lengths of, for example, stainless steel or aluminum tubing. Snubbers 152 are, for example, pivotally, supported upon frame 154. The weight of the snubbers 152 is such that snubbers 152 effectively stop, with relatively little deflection, and without damage to the leading edges of sheets 102, the motion of the sheets 102 as sheets 102 are ejected from the end of conveyor 134 and fall onto either supports 142 or supports 140 if supports 142 are retracted. The distance between reference surface 150 and the snubbers 152 may also be adjustable to accommodate different width sheets 102 by moving frame 154 relative to conveyor 134 in the same manner as stop 149.

Figure 9:
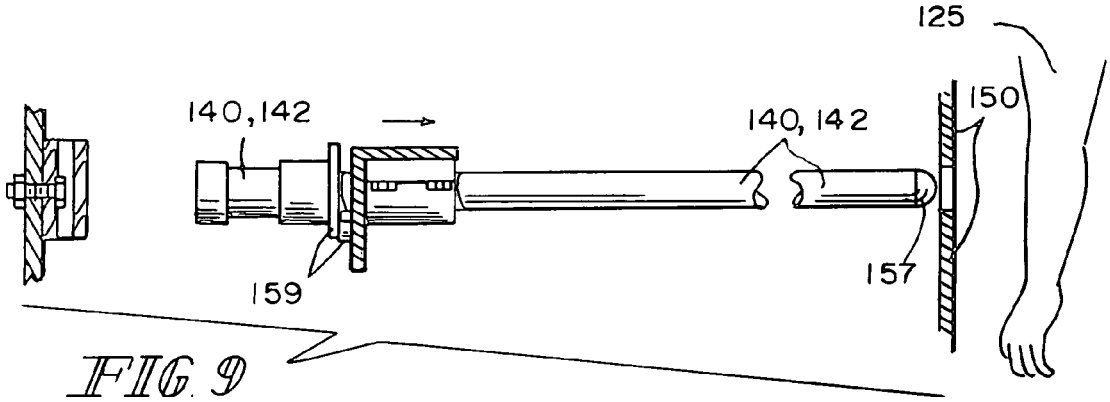
FIGS. 9-10 illustrate enlarged fragmentary sectional side elevational views of certain details illustrated in FIGS. 5-8, in two different orientations.
Figure 10:
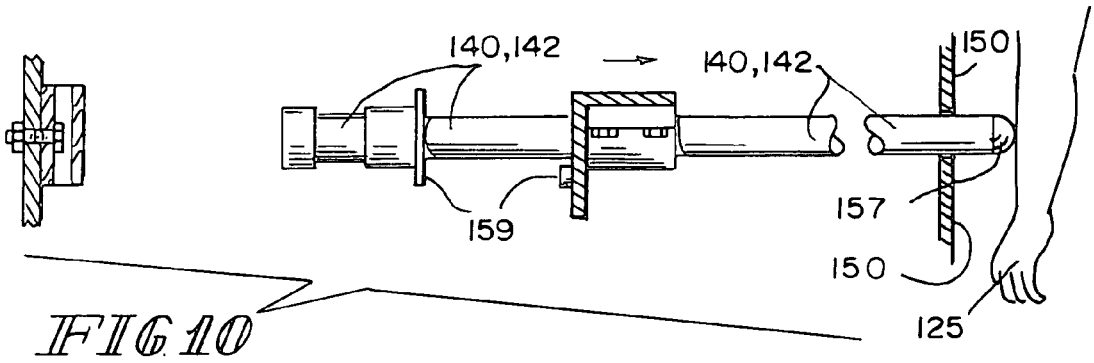
Figure 11:
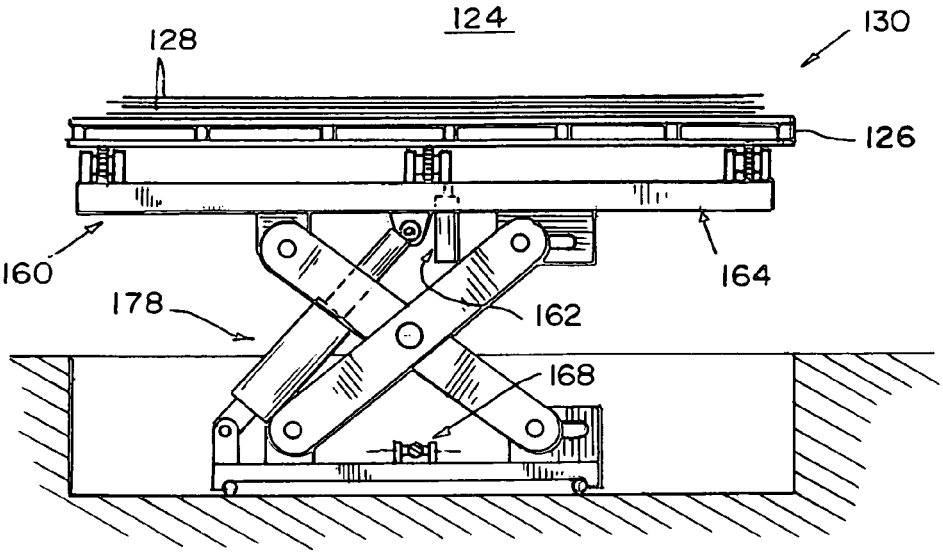
FIG. 11 illustrates a fragmentary front elevational view of certain details of the apparatus illustrated in FIG. 2.

To aid in protecting the offbearers 125, the outer ends of supports 140, 142 may be tipped with elastomer tips 157. FIGS. 9-10. Additionally, adjacent its inner end, each support 140, 142 is provided with a magnetic coupling 159 to its respective motor 146, 144. See FIGS. 8-10. Should a support 140, 142 contact an offbearer 125, once the force of the contact exceeds the holding force of the magnetic coupling 159, the support 140, 142 breaks the magnetic coupling 159 and stops even though the motor 144, 146 continues its outward stroke, moving adjacent supports 140, 142 outward to their fully projected orientations. The uncoupled support 140, 142 is recoupled through the magnetic coupling 159 to its respective motor 146, 144 on the return stroke of the motor 146, 144.

Additionally, more outward supports 140, 142 from the center of the conveyor 134 may be projected and retracted by separate motors 146, 144, typically in pairs, under the control of controller 138. In this way, if the sensors 137 sense shorter length sheets 102 exiting the dryer 120, controller 138 may control the separate motors 146, 144 so that the more outward supports 140, 142 from the center of conveyor 134 are not projected when they are not necessary to support the shorter length sheets 102. This permits the offbearers 125 easier access to the ends of bundles 128 of shorter length sheets 102, facilitating handling of the bundles and enhancing offbearer 125 safety.

Figure 5:
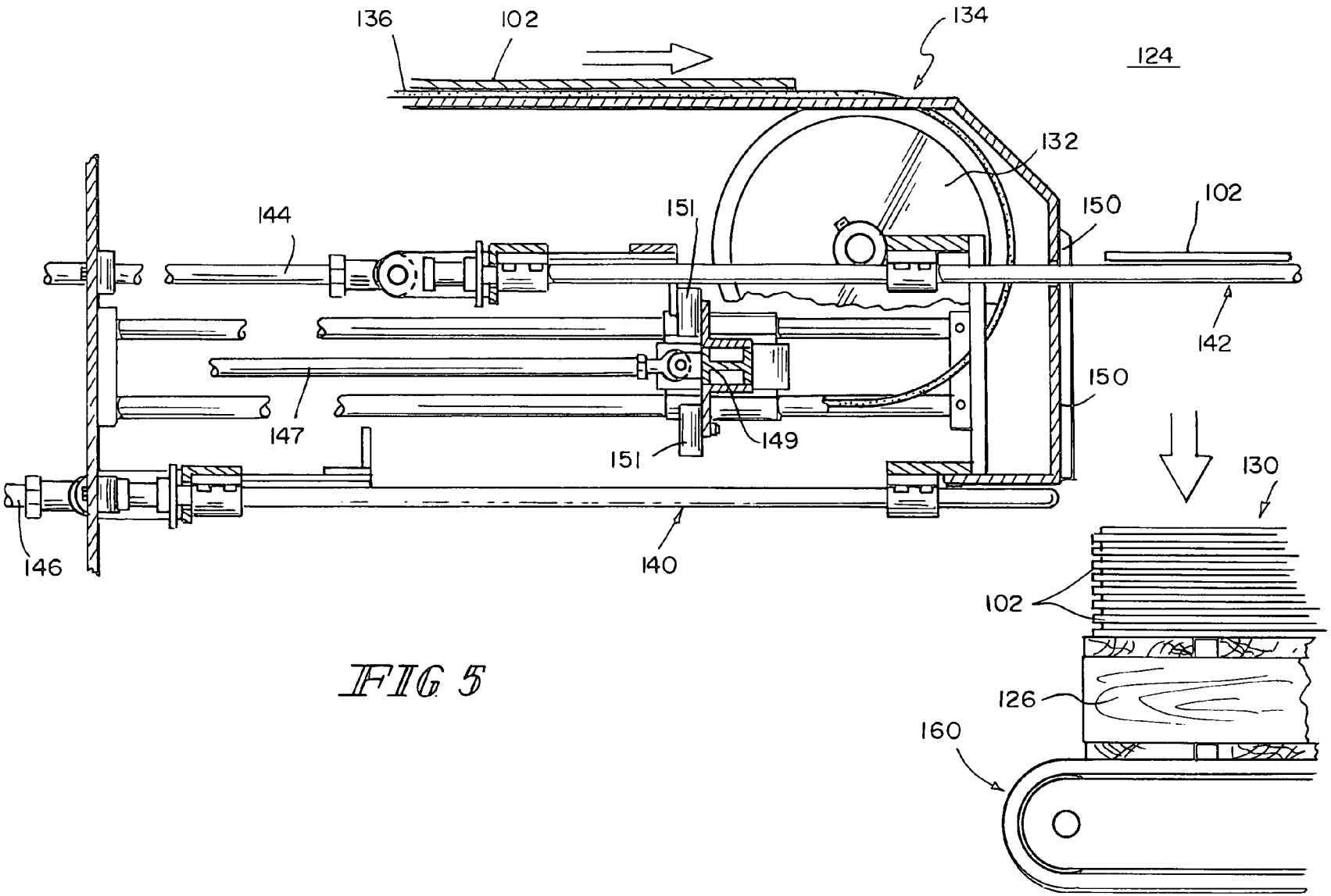
FIGS. 5-7 illustrate enlarged, fragmentary sectional side elevational views of certain details illustrated in FIG. 4.
Figure 5A:
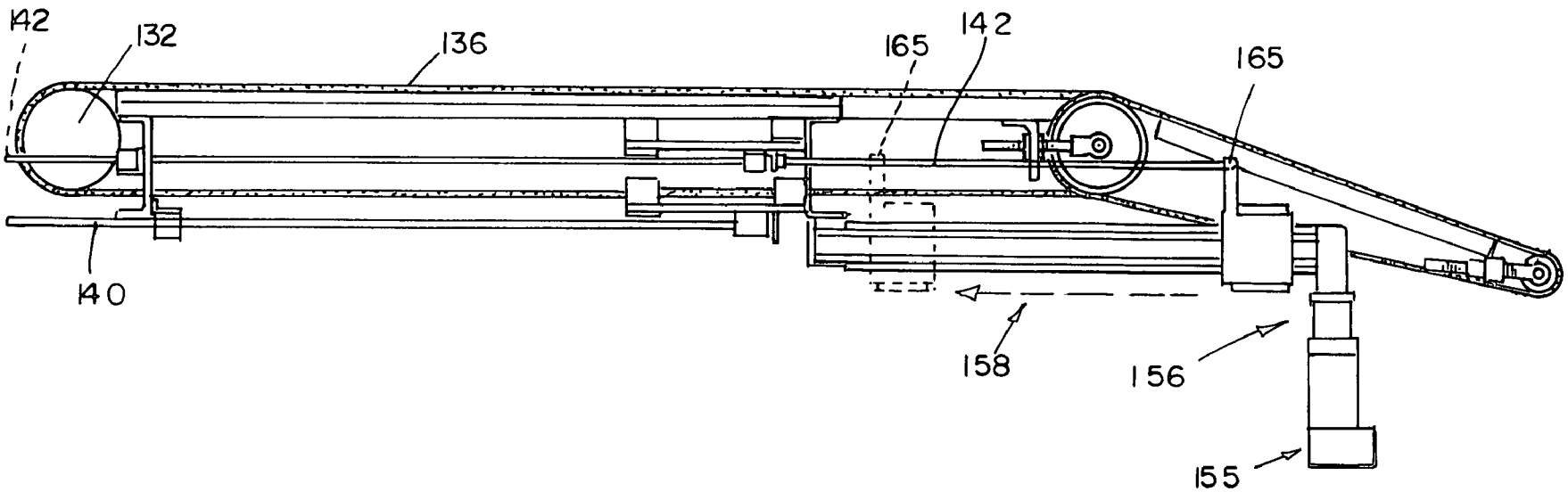
FIG. 5*a* illustrates an alternative detail to the details illustrated in FIGS. 5-7.
Figure 6:
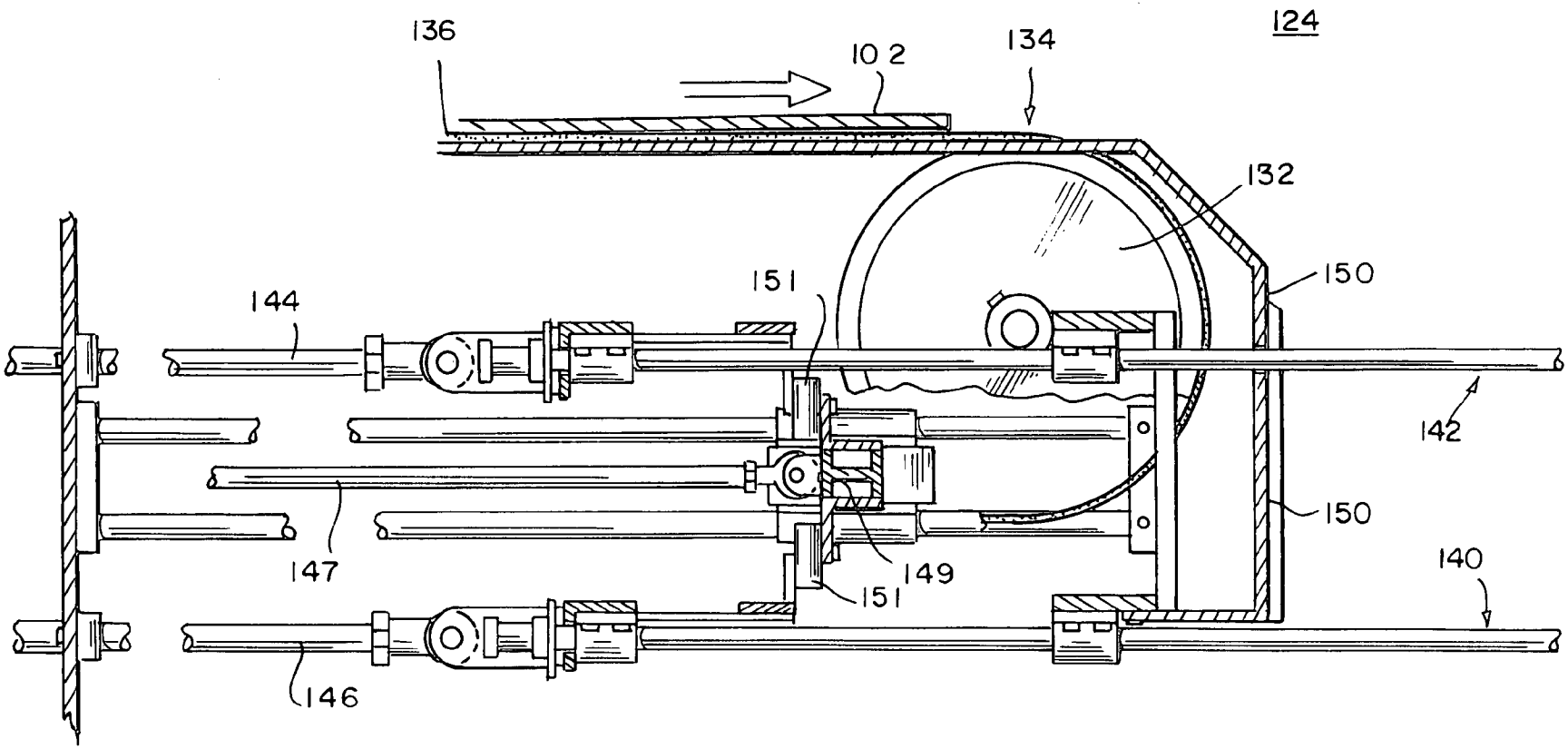
Figure 7:
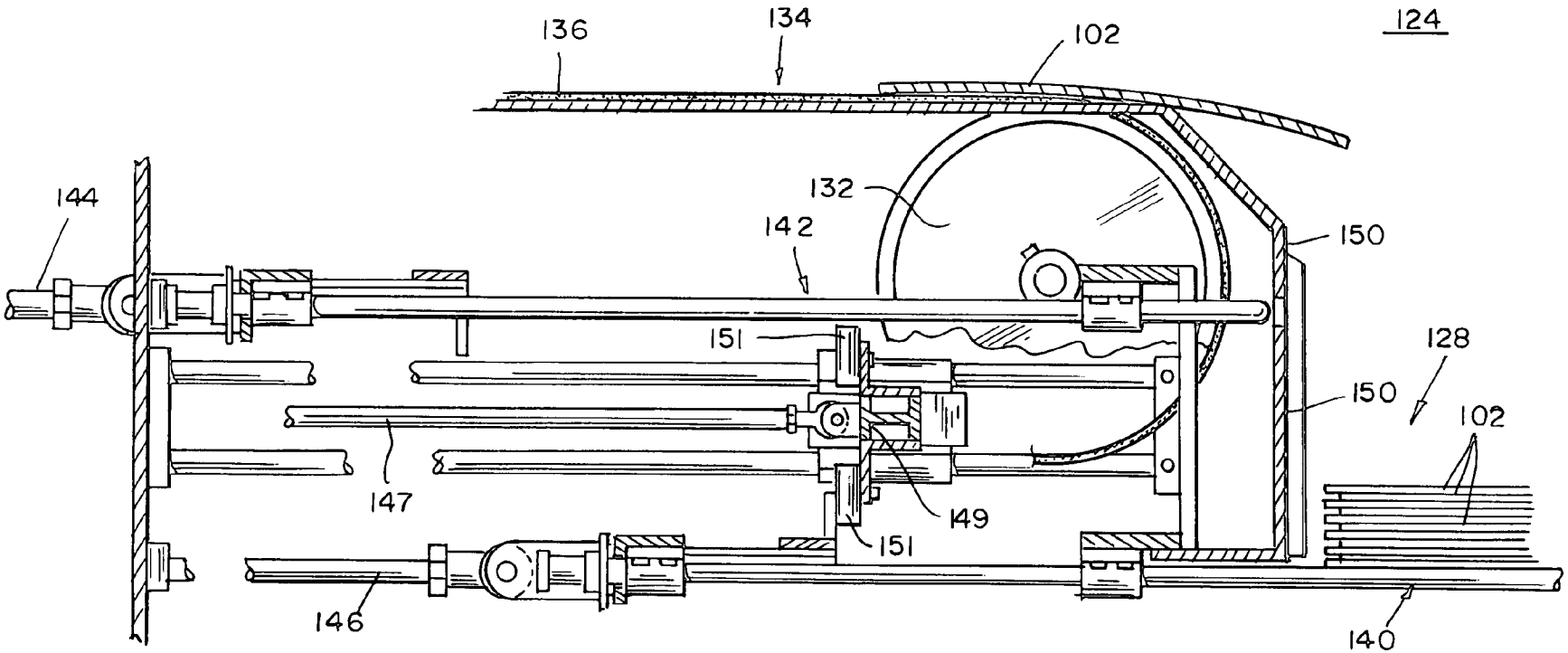
Figure 8:
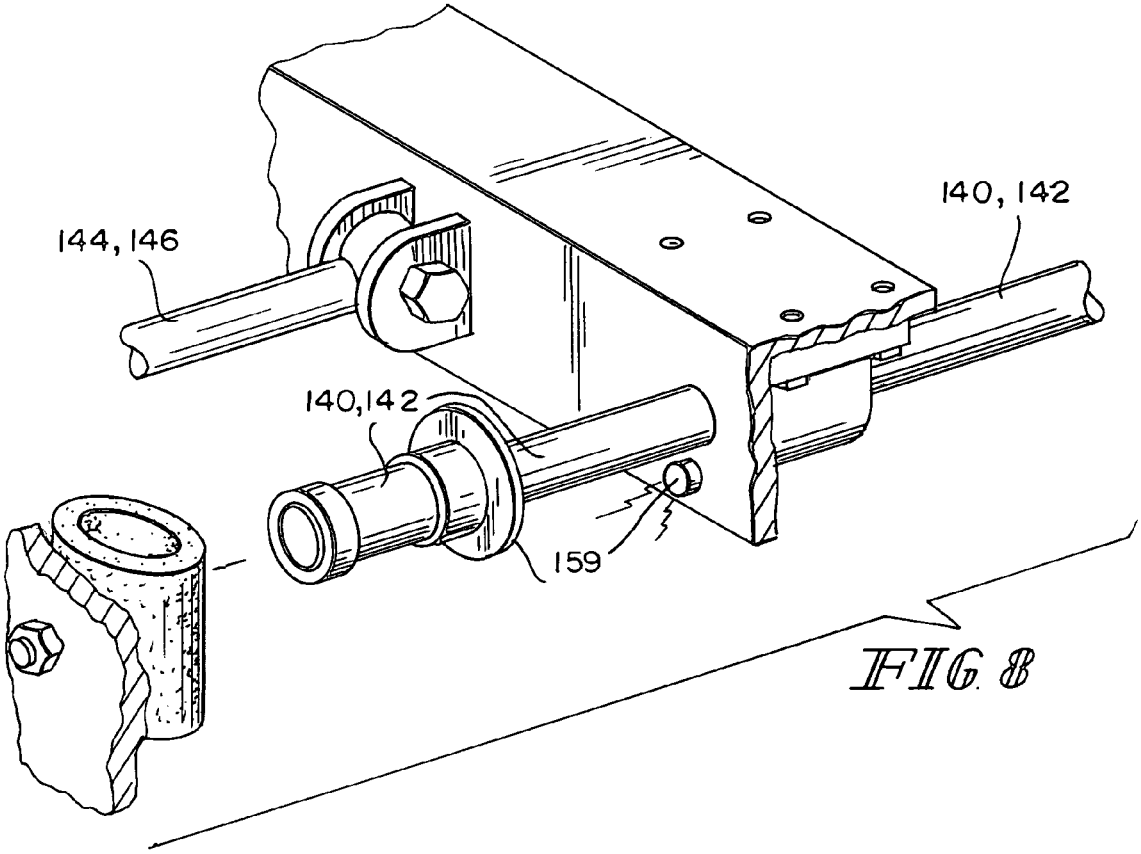
FIG. 8 illustrates an enlarged fragmentary perspective view of certain details illustrated in FIGS. 5-7.

Another mechanism for positioning the pins 140, 142 is illustrated in FIG. 5*a*. A DC servomotor 155 is coupled through a transmission 156 to a timing belt drive system 158 including pulleys at each of its ends. The timing belt system 158 is coupled at 165 to the top pins 142 to actuate the pins 142 in and out as the timing belt is moved in the forward and reverse directions. A similar mechanism can be provided for pins 140. This mechanism permits somewhat higher projection and retraction speeds of pins 140, 142 than, for example, piston-and-cylinder pneumatic motors 144, 146, for example, by permitting the controller 138 to control the projection and retraction of pins 140, 142 through acceleration and deceleration curves, such as, for example, linear ramps, on projection and/or retraction. Relatively careful control, particularly of acceleration on projection of the pins 140, 142, aids to prevent breaking of the magnetic couplings 159. This arrangement also provides somewhat more precise control of the projected positions of pins 140, 142 and permits elimination of the stop(s) 149 and bumpers 151 to limit the pins' 140s', 142s' strokes.

Referring now more particularly to FIGS. 11-14, each bundle 128 is offset slightly from the bundle 128 directly beneath it for convenience in subsequent handling and processing. Also for convenience, the sheets 102 from each flitch 112 are typically segregated, for example, by separating the stacks 130 of sheets 102 from preceding and succeeding flitches 112. Generally, a component of the slicer 116, such as, for example, the knife carriage, signals that the system has reached the end of a slicing operation on a particular flitch 112 by issuing an "end of slicing" signal once the knife carriage reaches a predetermined proximity to the flitch table. Once this command is issued, the knife carriage is retracted, movement of the table is stopped, and unloading and reloading are effected. The controller 138 also receives this signal, which the controller 138 uses, along with other signals it receives, to coordinate the operation of the illustrated material handling system.

To aid in segregating each bundle 128 and segregating the veneer sliced from preceding and succeeding flitches 112, the apparatus includes a pallet 126 manipulator 160. The pallet manipulator 160 includes a conveyor 161, illustratively an electric motor-driven roller chain-and-sprocket conveyor, adapted to be tilted by a tilting mechanism 162. See FIG. 13. Conveyor 161 is pivotally mounted 163 adjacent an end 164 thereof adjacent the offbearers' station 124 to pivot an end 166 thereof remote from end 164 upward and downward. This permits an empty pallet 126 to be placed onto conveyor 161 when end 166 is raised, with the end 166 then being pivoted downward to orient the pallet 126 horizontally.

Figure 2:
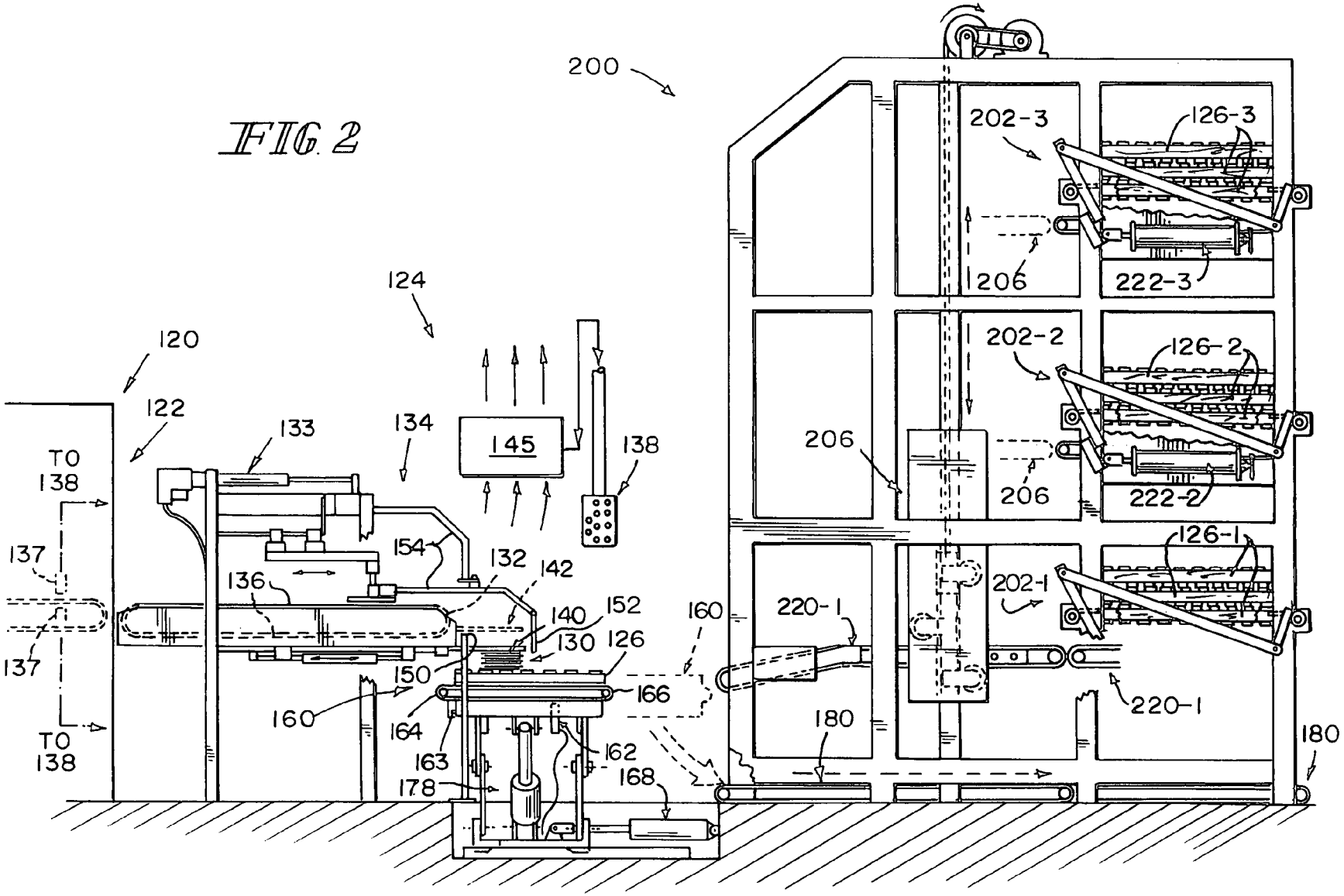
FIG. 2 illustrates a fragmentary side elevational view of certain details of an apparatus for performing part of the process illustrated in FIG. 1.
Figure 3:
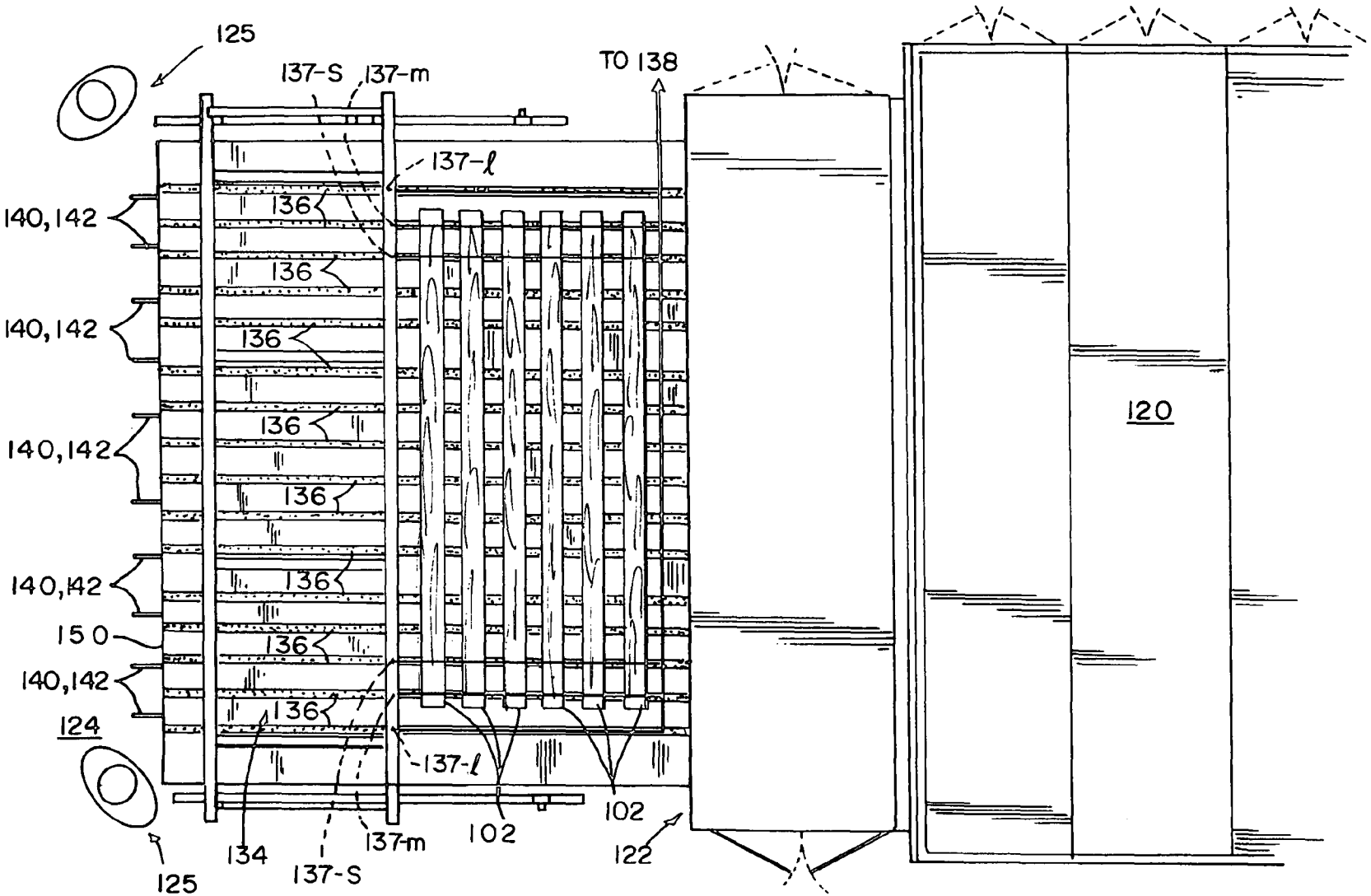
FIG. 3 illustrates a fragmentary top plan view of certain details of the apparatus illustrated in FIG. 2.
Figure 4:
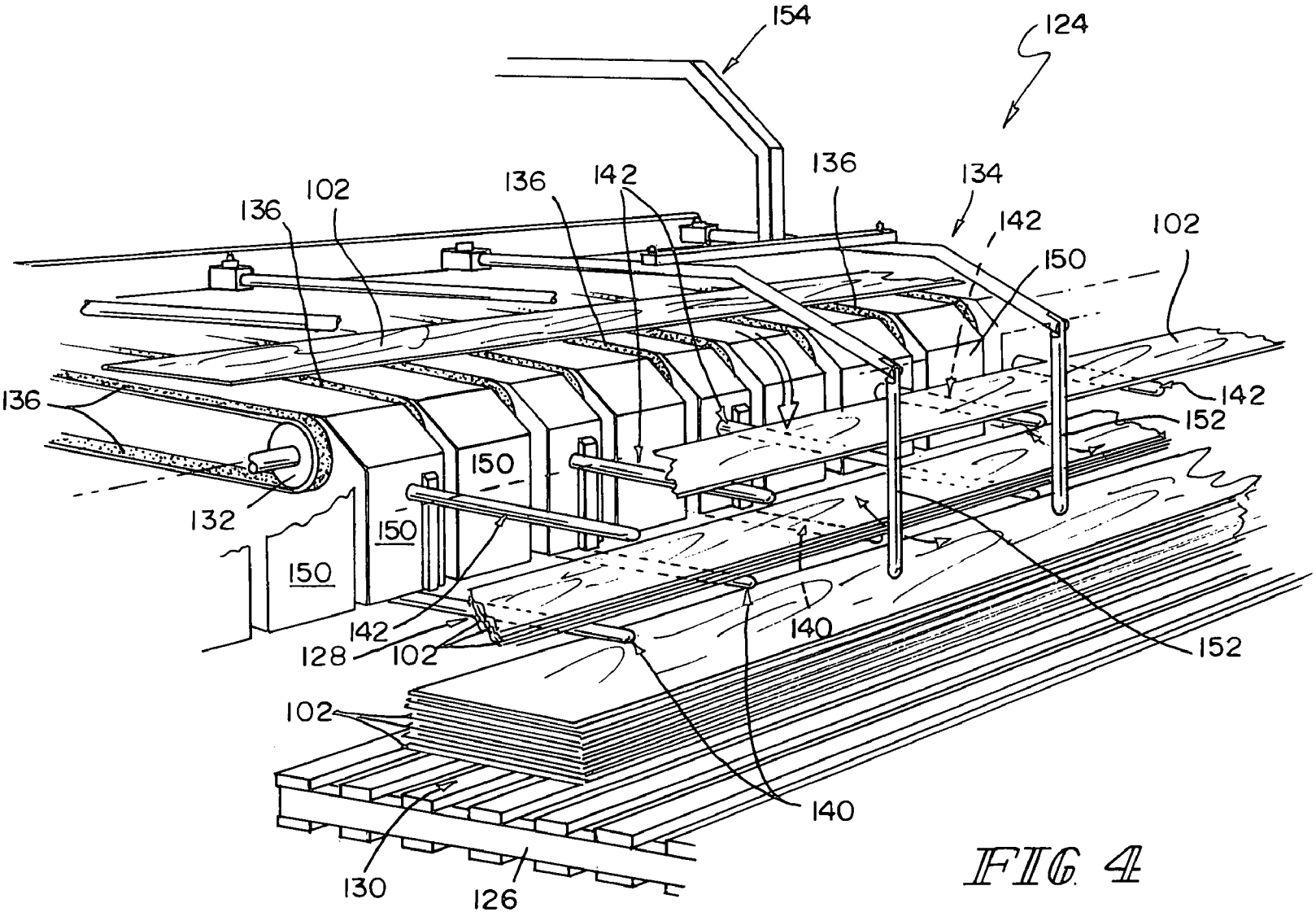
FIG. 4 illustrates an enlarged fragmentary perspective view of certain details of the apparatus illustrated in FIGS. 2-3.
Figure 12:
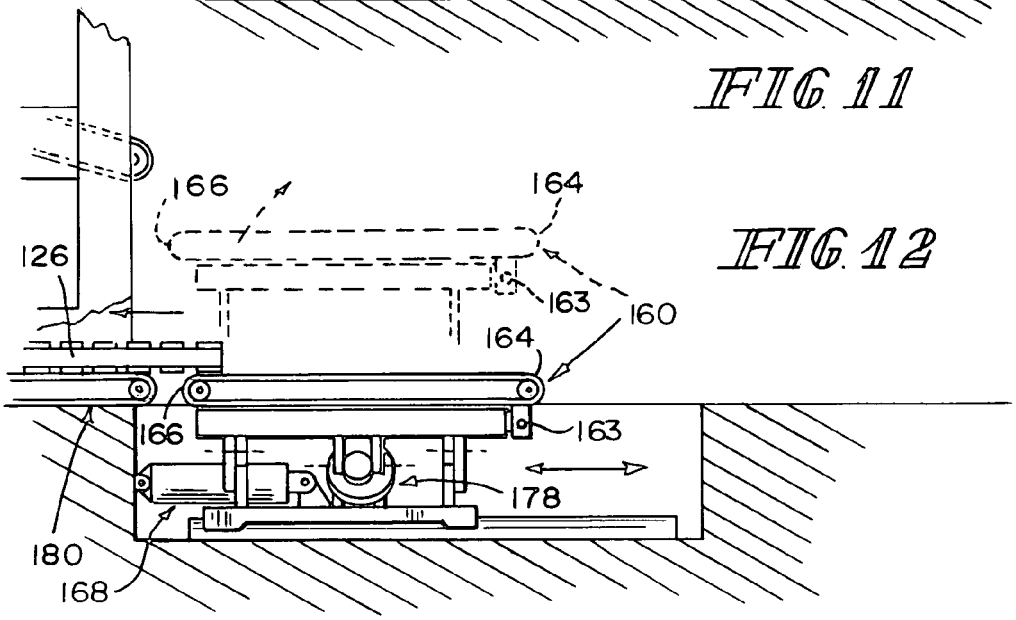
FIGS. 12-13 illustrate fragmentary side elevational views of certain details illustrated in FIG. 11, in two different orientations.
Figure 13:
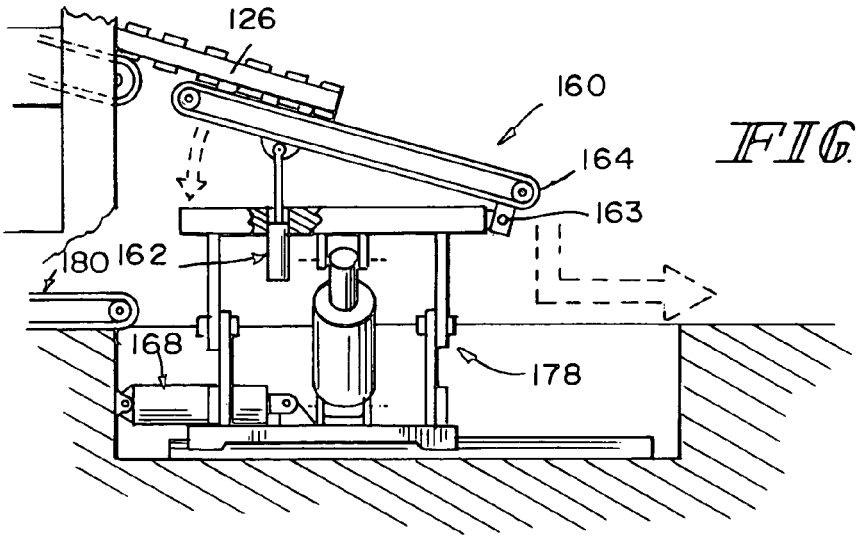
Figure 14:
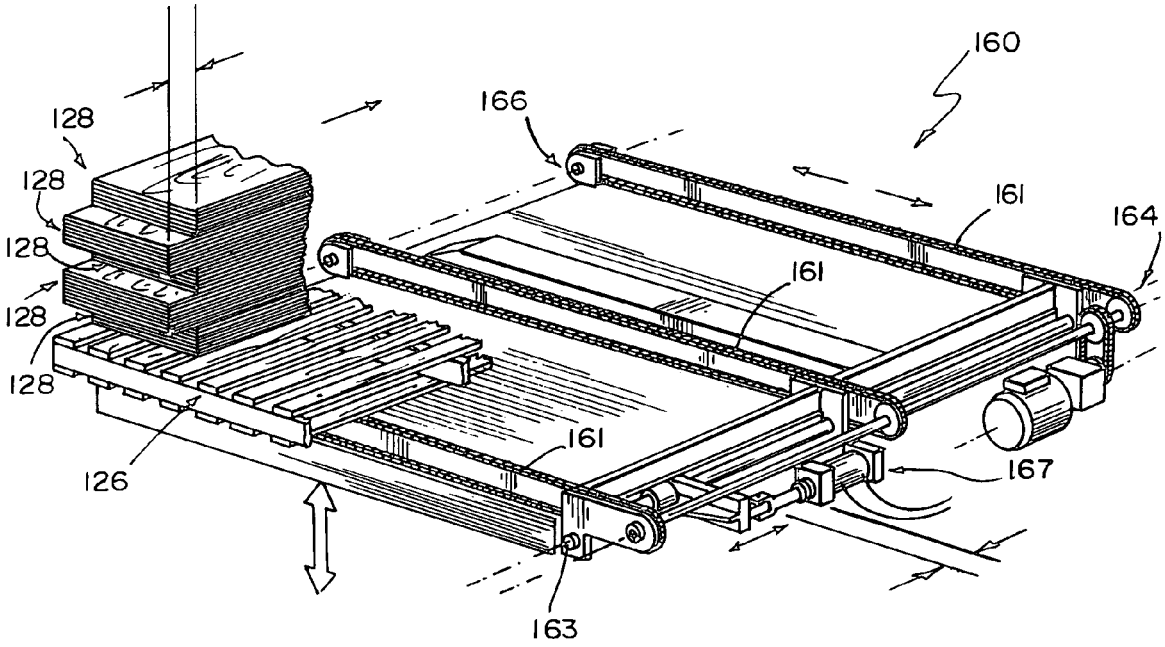
FIG. 14 illustrates an enlarged fragmentary perspective view of certain details of the apparatus illustrated in FIGS. 11-13.
Figure 15:
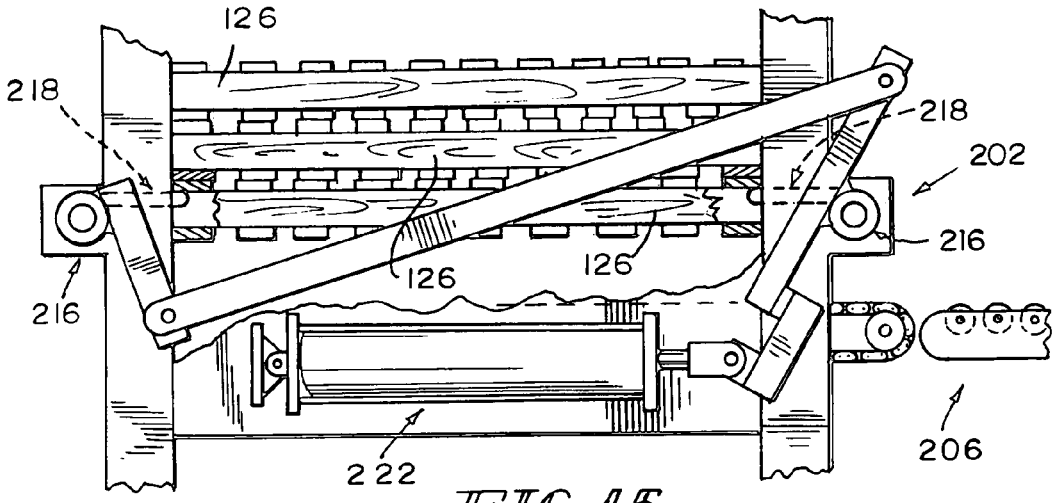
FIGS. 15-17 illustrate fragmentary side elevational views of certain details of the apparatus illustrated in FIG. 2, in three different orientations; and, FIG. 18 illustrates an enlarged fragmentary perspective view of certain details of the apparatus illustrated in FIG. 2.
Figure 16:
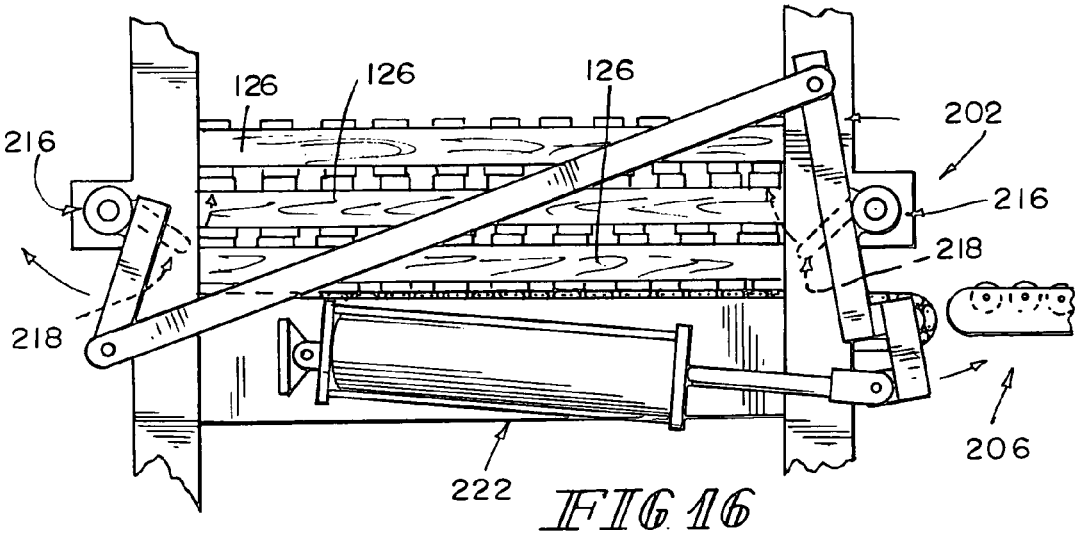
Figure 17:
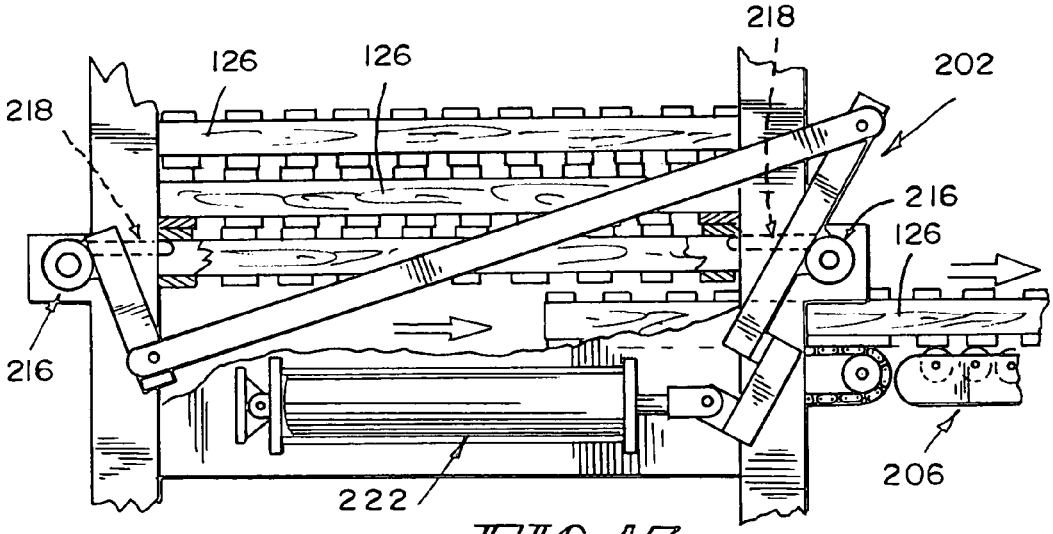

Referring particularly to FIG. 14, pallet manipulator 160 also includes a shifting mechanism 167, illustratively a hydraulic or pneumatic piston-and-cylinder motor, to shift the conveyor horizontally transversely of the direction of conveyance of sheets 102 along conveyor 134 between bundles 128 to assist in offsetting each bundle 128 transversely of the direction of conveyance of sheets 102 along conveyor 134 from the bundles 128 directly above and below it in the stack 130. Referring particularly to FIGS. 2, 12 and 13, pallet manipulator 160 also includes a shifting mechanism 168, illustratively a hydraulic or pneumatic piston-and-cylinder motor, to shift the conveyor 161 horizontally toward and away from the offbearers' station 124. Illustratively, conveyor 161 then orients a pallet 126 to receive a first number of bundles 128 of sheets 102 cut from a first flitch 112 in a first stack 130. Then shifting mechanism 168 shifts the conveyor 161 so that the pallet 126 is oriented to receive a second number of bundles 128 of sheets 102 cut from a second flitch 112 in a second stack 130 adjacent the first on pallet 126.

Referring now particularly to FIGS. 2 and 11-13, pallet manipulator 160 further includes an elevator mechanism 178, illustratively a hydraulic or pneumatic piston-and-cylinder motor, which permits conveyor 161 to be lowered. This assists (a) separator(s), such as (a) sheet(s) of corrugated paperboard or the like, to be placed on top of the two adjacent stacks 130 of sheets 102 on pallet 126, and two more stacks 130 of sheets 102 to be placed on top of the first two stacks 130 in the same manner as the first two stacks 130 were placed on the pallet 126. Thus, a fully loaded pallet 126 might include, for example, four separate stacks 130 of bundles 128 of sheets 102, two upper and two lower, separated by, for example, (a) corrugated paperboard divider(s), representing the veneer 102 sliced from four separate flitches 112. The fully loaded pallet 126 is then discharged by the pallet manipulator 160 onto an exit conveyor 180 by sequential actuation of shifting mechanism 168 and conveyor 161.

Referring now particularly to FIGS. 2 and 15-17, the material handling system also includes a pallet 126 dispenser 200 which dispenses pallets 126-1, 126-2, . . . **126-*n* of different lengths onto the pallet manipulator 160 based, for example, upon information entered into the controller 138 by the offbearer(s) 125, or upon information coupled from the scanner(s) 137-*s*, 137-*m*, 137-*l* to the controller 138. In the illustrated embodiment, n=3. That is, the dispenser 200 includes three bays or magazines 202-1, 202-2, 202-3 from which pallets 126-1, 126-2, 126-3 of three different lengths, illustratively, about 10, about 12 and about 14 feet (about 3.05 m, about 3.66 m and about 4.27 m), respectively, are dispensed, based upon information supplied either from scanner(s) 137-*s*, 137-*m*, 137-*l* or by operator, for example, offbearer 125, entry via controller 138**.

The magazines 202-1, 202-2, 202-3 form three different levels of the dispenser 200, with elevator mechanism 206 delivering pallets 126-2, 126-3 from the two upper level magazines 202-2, 202-3, respectively, to a conveyor 220-1 at the lowest level to be conveyed to the pallet manipulator 160. In each magazine 202-1, 202-2, 202-3, a pallet 126-1, 126-2, 126-3 is dispensed from the bottom of a stack of such pallets 126-1, 126-2, 126-3 by rotating a pair of shafts 216 in opposite directions. Dogs 218 are attached to shafts 216 so that, when the shafts 216 are rotated in opposite directions, the dogs 218 pivot out from beneath the respective stack of pallets 126-1, 126-2, 126-3, dropping the stack 126-1, 126-2, 126-3 onto a conveyor 220-1, 220-2, 220-3, illustratively an electric motor-driven roller chain-and-sprocket conveyor. The bottom-most pallet 126-1, 126-2, 126-3 resting on the conveyor 220-1, 220-2, 220-3 holds the pallets above it so that, as the shafts 216 are pivoted back into their pallet-dogging positions, the respective dogs 218 lift all the pallets 126-1, 126-2, 126-3 above the bottom-most pallet 126-1, 126-2, 126-3 clear of the bottom-most pallet 126-1, 126-2, 126-3. The bottom-most pallet 126-2, 126-3 is then delivered by its respective conveyor 220-2, 220-3 to the elevator mechanism 206. The shafts 216 are rotated to release and capture pallets 126-1, 126-2, 126-3 by respective prime movers, illustratively, hydraulic piston-and-cylinder motors 222-1, 222-2, 222-3 and associated linkages to shafts 216.

Figure 18:
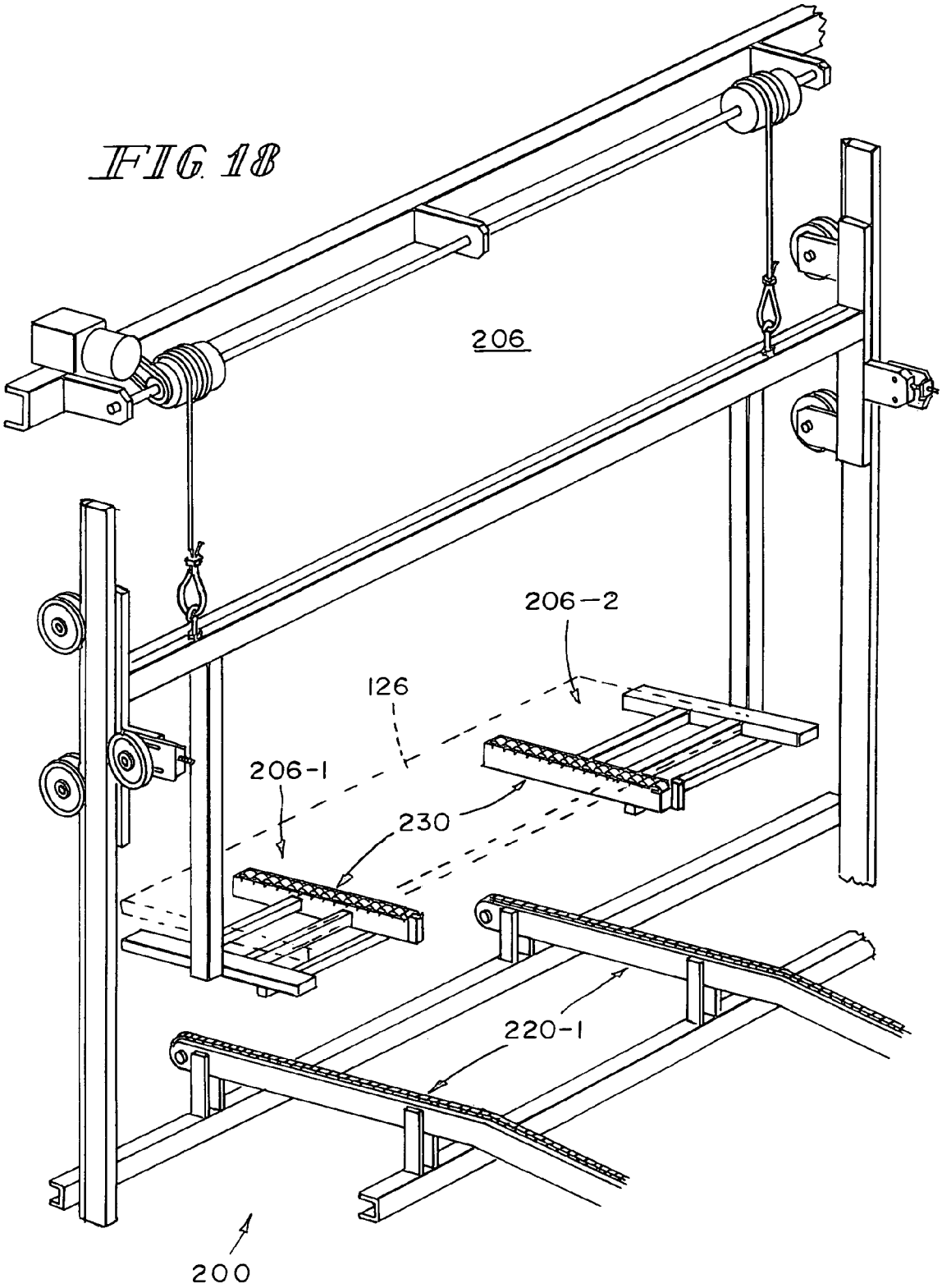

Referring now particularly to FIG. 18, the elevator mechanism 206 includes two elements 206-1, 206-2 coupled together at their upper extents. Each element 206-1, 206-2 includes idler rollers 230. The idler rollers 230 of the two elements 206-1, 206-2 are laterally spaced apart a distance slightly greater than the width of the bottom conveyor 220-1. The thus-delivered pallet 126-2, 126-3 is then conveyed by the elevator mechanism 206 downward until the idler rollers 230 are at or below the level of bottom conveyor 220-1, depositing the pallet 126-2, 126-3 upon the bottom conveyor 220-1. Of course, if the pallet 126-1 is selected from magazine 202-1, the pallet 126-1 is already on bottom conveyor 220-1. In any event, the selected pallet 126-1, 126-2, 126-3 is then conveyed by conveyor 220-1 toward, and deposited over the raised end 166 of, the upwardly tilted conveyor 161. Illustratively, the elevator mechanism 206 includes an electric motor-driven cable winch, and is counterbalanced to reduce the speed of the elevator 206's descent in the event of malfunction.

What is claimed is:

1. A conveyor for conveying sheets and for depositing the sheets at a location to be stacked into stacks of sheets, the conveyor including a sensor for determining the presence of a sheet before the sheet arrives at the location, a first movable support for projecting into a projected orientation to receive the sheets as the sheets exit the conveyor, a controller coupled to the sensor and responsive to sensor inputs for controlling the first movable support, a first drive for projecting the first movable support into the projected orientation, the first drive coupled to the controller to be controlled thereby, the first drive comprising a magnetic coupler adapted to be overcome if the first movable support encounters resistance to projection into the projected orientation, the first movable support moving to a retracted orientation to assist a stack to be withdrawn therefrom, a plurality of second movable supports, the sheets comprising sheets of varying length, the sensor comprising a sensor for determining the presence and length of the sheets and for signaling to the controller the length of the sheets being conveyed, and the controller separately controlling the second movable supports to project only that number of second movable supports that lie within the length of the sheets being conveyed.

2. The apparatus of claim 1 including a second drive for projecting the second movable supports into projected orientations, the second drive coupled to the controller to be controlled thereby.

3. The apparatus of claim 2 wherein the second drive comprises a magnetic coupler adapted to be overcome if the second movable supports encounter resistance to projection into the projected orientation.

4. The apparatus of claim 1 comprising a plurality of first movable supports, the sheets comprising sheets of varying length, the sensor comprising a sensor for determining the presence and length of the sheets and for signaling to the controller the length of the sheets being conveyed, and the controller separately controlling the first movable supports to project only that number of first movable supports that lie within the length of the sheets being conveyed.

5. The apparatus of claim 4 further including devices for retarding motion of the sheets as the sheets exit the conveyor, the devices being movably supported with respect to the conveyor.

6. The apparatus of claim 5 wherein the devices are movably supported so that their distances from a surface of the conveyor can be separately adjusted to accommodate sheets having non-uniform widths.

7. The apparatus of claim 1 comprising second movable supports adapted to project varying distances, the sheets comprising sheets of varying width, the sensor comprising a sensor for determining the presence, length and width of the sheets and for signaling to the controller the width of the sheets being conveyed, and the controller controlling the second movable supports to project the second movable supports a distance necessary to support the width of the sheets being conveyed.

8. The apparatus of claim 7 including a second drive for projecting the second movable supports into projected orientations, the second drive coupled to the controller to be controlled thereby.

9. The apparatus of claim 8 wherein the second drive comprises a magnetic coupler adapted to be overcome if the second movable supports encounter resistance to projection into the projected orientation.

10. The apparatus of claim 1 further including devices for retarding motion of the sheets as the sheets exit the conveyor, the devices being movably supported with respect to the conveyor.

11. The apparatus of claim 10 wherein the devices are movably supported so that their distances from a surface of the conveyor can be separately adjusted to accommodate sheets having non-uniform widths.

12. A conveyor for conveying sheets and for depositing the sheets at a location to be stacked into stacks of sheets, the conveyor including a sensor for determining the presence of a sheet before the sheet arrives at the location, a first movable support for projecting into a projected orientation to receive the sheets as the sheets exit the conveyor, a controller coupled to the sensor and responsive to sensor inputs for controlling the first movable support, a first drive for projecting the first movable support into the projected orientation, the first drive coupled to the controller to be controlled thereby, the first drive comprising a magnetic coupler adapted to be overcome if the first movable support encounters resistance to projection into the projected orientation, the first movable support moving to a retracted orientation to assist a stack to be withdrawn therefrom, a plurality of second movable supports, the sheets comprising sheets of varying length, the sensor signaling to the controller the length of the sheets being conveyed, and the controller separately controlling the second movable supports to project only that number of second movable supports that lie within the length of the sheets being conveyed, the second movable supports moving to projected orientations before the first movable support moves to a retracted orientation.

13. The apparatus of claim 12 including a second drive for projecting the second movable supports into projected orientations, the second drive coupled to the controller to be controlled thereby.

14. The apparatus of claim 13 wherein the second drive comprises a magnetic coupler adapted to be overcome if the second movable support encounters resistance to projection into the projected orientation.

15. A conveyor for conveying sheets and for depositing the sheets at a location to be stacked into stacks of sheets, the conveyor including a sensor for determining the presence of a sheet before the sheet arrives at the location, a first movable support for projecting into a projected orientation to receive the sheets as the sheets exit the conveyor, a controller coupled to the sensor and responsive to sensor inputs for controlling the first movable support, a first drive for projecting the first movable support into the projected orientation, the first drive coupled to the controller to be controlled thereby, the first drive comprising a magnetic coupler adapted to be overcome if the first movable support encounters resistance to projection into the projected orientation, the first movable support moving to a retracted orientation to assist a stack to be withdrawn therefrom, second movable supports adapted to project varying distances, the sheets comprising sheets of varying width, the sensor comprising a sensor for determining the presence and width of the sheets and for signaling to the controller the width of the sheets being conveyed, and the controller controlling the second movable supports to project the second movable supports a distance necessary to support the width of the sheets being conveyed.

16. The apparatus of claim 15 including a second drive for projecting the second movable supports into projected orientations, the second drive coupled to the controller to be controlled thereby.

17. The apparatus of claim 16 wherein the second drive comprises a magnetic coupler adapted to be overcome if the second movable supports encounter resistance to projection into the projected orientation.

18. The apparatus of claim 15 further including devices for retarding motion of the sheets as the sheets exit the conveyor, the devices being movably supported with respect to the conveyor.

19. The apparatus of claim 18 wherein the devices are movably supported so that their distances from a surface of the conveyor can be separately adjusted to accommodate sheets having non-uniform widths.

20. A conveyor for conveying sheets and for depositing the sheets at a location to be stacked into stacks of sheets, the conveyor including a sensor for determining the presence of a sheet before the sheet arrives at the location, first movable supports for projecting into projected orientations to receive the sheets as the sheets exit the conveyor, a controller coupled to the sensor and responsive to sensor inputs for controlling the first movable supports, a first drive for projecting the first movable supports into the projected orientations, the first drive coupled to the controller to be controlled thereby, the first drive comprising a magnetic coupler adapted to be overcome if the first movable supports encounter resistance to projection into the projected orientations, the first movable supports moving to a retracted orientation to assist a stack to be withdrawn therefrom, the first movable supports adapted to project varying distances, the sheets comprising sheets of varying width, the sensor comprising a sensor for determining the presence and width of the sheets and for signaling to the controller the width of the sheets being conveyed, and the controller controlling the first movable supports to project the first movable supports a distance necessary to support the width of the sheets being conveyed.

21. The apparatus of claim 20 further including devices for retarding motion of the sheets as the sheets exit the conveyor, the devices being movably supported with respect to the conveyor.

22. The apparatus of claim 21 wherein the devices are movably supported so that their distances from a surface of the conveyor can be separately adjusted to accommodate sheets having non-uniform widths.

* * * * *